US005962072A

United States Patent [19]

Yerman

[11] Patent Number: 5,962,072

[45] Date of Patent: Oct. 5, 1999

[54] PAINT MASK

[76] Inventor: Arthur J. Yerman, 76 Grand Ave., Toms River, N.J. 08753

[21] Appl. No.: 09/128,259

[22] Filed: Aug. 3, 1998

[51] Int. Cl.[6] ..... B05D 1/00

[52] U.S. Cl. ..... 427/282; 118/504; 118/505

[58] Field of Search ..... 118/504, 505; 427/282

[56] References Cited

U.S. PATENT DOCUMENTS

| | | | |
|---|---|---|---|
| 2,286,473 | 6/1942 | Dugan | 118/505 |
| 2,371,859 | 3/1945 | Wallace | 118/505 |
| 4,406,246 | 9/1983 | Demeyer et al. | 118/505 |
| 4,915,058 | 4/1990 | Murray | 118/505 |

*Primary Examiner*—Laura Edwards

*Attorney, Agent, or Firm*—McAulay Nissen Goldberg Kiel & Hand, LLP

[57] ABSTRACT

A paint mask for shielding a surface to be masked from paint being applied to an adjacent or nearby surface is described. The paint mask is formed of an elastic, substantially gas-impermeable material and has a suction cup surrounded by a flange. Together, the suction cup and flange are sized and shaped to cover the surface to be masked. In the side of the flange which contacts the surface to be masked, there are channels which communicate with the interior of the suction cup, such that when the paint mask is placed on the surface to be masked, an enclosed space is defined by the suction cup, the channels and the surface to be masked. Pressing down on the outside of the suction cup causes a portion of the air inside the enclosed space to escape. When the suction cup is released, a partial vacuum forms in the enclosed space which fixes the paint mask to the surface to be masked.

18 Claims, 4 Drawing Sheets

PAINT MASK

FIELD OF THE INVENTION

The present invention relates generally to a paint mask, and more particularly to a paint mask used for painting a window frame.

BACKGROUND OF THE INVENTION

Masking is a common method of protecting a surface from receiving paint when paint is being applied to an adjacent or nearby surface. For instance, when painting window frames, it is undesirable to get paint on the glass of a window. It is well known to apply masking tape to the glass before painting the window frames to protect the glass from paint. It is also common to make a cut-out of paper sized to fit over the glass and use tape to secure the edges to the glass. After painting, the masking tape and/or paper are removed and disposed of, leaving the glass underneath free of paint. Although the materials used are inexpensive and adaptable to any surface size or shape, this method of masking suffers from being very labor intensive.

To address this problem, several reusable masks have been developed which require less labor. U.S. Pat. No. 2,286,473, for example, shows an apron for covering the lower half of an automobile body while the top half is being painted. The apron is attached at the top to the automobile body by a rubber strip containing a passage connected to a vacuum pump. The rubber strip also contains numerous ports spaced periodically in the passage which vent the partial vacuum in the passage to the surface of the auto body to secure the apron to the auto body. The top of the apron forms the sharp division between the area to be painted and the area protected from paint. The apron also has suction cups attached to its bottom which are used to fix the bottom of the apron to the lower parts of the auto body, preventing the apron from flapping during paint application.

U.S. Pat. No. 2,371,859 also shows an apron for masking the lower half of an automobile body while the top half is being painted. In this case, the fabric apron is also attached at the top to the automobile body by a rubber strip containing a row of large suction pockets. The large suction pockets are provided to secure the strip of rubber to the automobile body and to support the weight of the apron. One or more rows of smaller suction pockets are provided at the edges of the rubber strip to adjust and perfect the placement of the strip's edges. Each pocket must form an individual seal with the automobile body, so application of the strip requires pressing the surface of the strip over each pocket.

U.S. Pat. No. 4,406,246 shows a rigid paint mask for covering a window. This mask is guided into position by contact with the molding around the window, and held in place by a suction cup mounted underneath each comer of the mask. These suction cups attach to the glass of the window.

U.S. Pat. No. 4,915,058 also shows a rigid paint mask for covering an automobile window. This mask has a suction cup at each end to attach the mask to the glass and is sized slightly smaller that the window. Because of the mask's size, it still requires the application of masking tape to mask the edges of the window and the molding surrounding the window.

Conventional paint masks, such as the ones described above, continue to have disadvantages. A primary drawback is that these masks are only cost-effective if very large numbers of identical items are being painted. This is due partially to the specificity of the mask, with each mask being manufactured for one particular size and shape of window, and partially to the relative expense of making these masks, all of which require either difficult custom manufacturing or the assembly of several parts.

OBJECTS AND SUMMARY OF THE INVENTION

Accordingly, it is an object of the present invention to provide an easily manufactured, inexpensive paint mask.

It is another object of the present invention to provide a durable, reusable paint mask which reliably remains attached to the surface to be masked.

It is yet another object of the present invention to provide a single manufactured paint mask which can be trimmed by the end user to a number of different sizes and shapes for use.

In accordance with one aspect of the invention, a paint mask for protecting an area from paint which is being applied to an adjacent or nearby area is provided. The paint mask comprises: a suction cup formed of an elastic, substantially gas-impermeable material, the suction cup having a concave inner surface and an outer surface; a flange formed of an elastic, substantially gas-impermeable material, the flange being attached to the suction cup and having a lower surface sized and shaped, in combination with the inner surface of the suction cup, to cover the area to be protected; and at least one channel in the lower surface of the flange, the surface of the channel being continuous with the concave inner surface of the suction cup; wherein, upon placing the paint mask on the surface to be protected an enclosed space is defined by the concave inner surface of the suction cup, the surfaces of the channels and the surface to be protected; and a partial vacuum can be created in the enclosed space by pressing on the outer surface of the suction cup to force a portion of the air contained in the enclosed space out of the enclosed space, followed by releasing the outer surface of the suction cup.

In the paint mask above, the suction cup has a circumferential edge, flange has an outer edge, and at least one of the channels extending radially a part of the distance from a circumferential edge of the suction cup to an outer edge of the flange.

The paint mask preferably includes at least one channel in the lower surface of the flange running substantially parallel to the outer edge of the flange and intersecting at least one of the radial channels, the surface of the channel substantially parallel to the outer edge being continuous with the surface of the intersecting radial channel, wherein, the enclosed space is defined by the concave inner surface of the suction cup, the surface of each of the channels and the surface to be protected.

Alternately, the paint mask preferably includes at least one channel in the lower surface of the flange concentric to the circumferential edge of the suction cup and intersecting at least one of the radial channels, the surface of the concentric channel being continuous with the surface of the intersecting radial channel, wherein, the enclosed space is defined by the concave inner surface of the suction cup, the surface of each of the channels and the surface to be protected.

In accordance with another aspect of the invention, the paint mask further includes a pressure sensitive adhesive applied to the lower surface of the flange. Preferably, the pressure sensitive adhesive is neoprene, latex or mucilage.

In accordance with yet another aspect of the invention, the suction cup and the flange are formed of a single molded or fabricated unit of the elastic, substantially gas impermeable material. Preferably, the substantially gas-impermeable material is at least one of rubber and polypropylene.

In accordance with yet another aspect of the invention, the paint mask comprises: a plurality of suction cups formed of an elastic, substantially gas-impermeable material, each suction cup having a concave inner surface and an outer surface; a flange formed of an elastic, substantially gas-impermeable material, the flange being attached to each suction cup and having a lower surface sized and shaped, in combination with the inner surfaces of the suction cups, to cover the area to be protected; and a plurality of channels in the lower surface of the flange, the surface of each channel being continuous with the concave inner surface of one of the suction cups; wherein, upon placing the paint mask on the surface to be protected an enclosed space is defined for each suction cup, that space being defined by the concave inner surface of that suction cup, the surfaces of the channels having surfaces continuous with the concave inner surface of that suction cup and the surface to be protected; and a partial vacuum can be created in each enclosed space by pressing on the outer surface of each suction cup to force a portion of the air contained in the enclosed space out of the enclosed space, followed by releasing the outer surface of each suction cup.

Preferably, in the paint mask above, each suction cup has a circumferential edge, the flange has an outer edge, and at least one of the channels extends radially a part of the distance from a circumferential edge of one of the suction cups to an outer edge of the flange.

Most preferably, at least one channel in the lower surface of the flange runs substantially parallel to the outer edge of the flange and intersects at least one of the radial channels, the surface of the channel substantially parallel to the outer edge is continuous with the surface of the intersecting radial channel, wherein, each enclosed space is defined by the concave inner surface of each suction cup, the surface of each of the channels has surfaces continuous with the inner surface of that suction cup, the surface of each of the channels intersects each of the channels having surfaces continuous with the inner surface of that suction cup and the surface to be protected.

Alternately, at least one channel in the lower surface of the flange is concentric to the circumferential edge of one of the suction cups and intersects at least one of the radial channels, the surface of the concentric channel is continuous with the surface of the intersecting radial channel, wherein, each enclosed space is defined by the concave inner surface of each suction cup, the surface of each of the channels has surfaces continuous with the inner surface of that suction cup, and the surface of each of the channels intersects each of the channels having surfaces continuous with the inner surface of that suction cup and the surface to be protected.

In accordance with another aspect of the invention, the paint mask further includes a pressure sensitive adhesive applied to the lower surface of the flange. Preferably, the pressure sensitive adhesive is neoprene, latex or mucilage.

In accordance with yet another aspect of the invention, the suction cup and the flange are formed of a single molded or fabricated unit of the elastic, substantially gas impermeable material. Preferably, the substantially gas-impermeable material is at least one of rubber and polypropylene.

Preferably, each enclosed space is located under a discreet section of the paint mask.

In a further aspect, the invention provides a method of painting a window frame containing a window pane comprising the steps of: (1) providing a paint mask for protecting the window pane from paint, the paint mask comprising: a plurality of suction cups formed of an elastic, substantially gas-impermeable material, each suction cup having a concave inner surface and an outer surface; a flange formed of an elastic, substantially gas-impermeable material, the flange being attached to each suction cup and having a lower surface sized and shaped, in combination with the inner surfaces of the suction cups, to cover the window pane; and plurality of channels in the lower surface of the flange, the surface of each channel being continuous with the concave inner surface of one of the suction cups; wherein, upon placing the paint mask on the window pane, an enclosed space is defined for each suction cup, that space being defined by the concave inner surface of that suction cup, the surfaces of the channels having surfaces continuous with the concave inner surface of that suction cup and the surface of the window pane; (2) trimming the flange of the paint mask on one or more sides to form an outer edge; (3) placing the trimmed paint mask over the window pane with the outer edge abutting the window frame, such that the entire surface of one side of the window pane is shielded from paint application; (4) creating a partial vacuum in the enclosed space by pressing on the outer surface of each suction cup to force a portion of the air contained in the enclosed space out of the enclosed space, followed by releasing the outer surface of each suction cup; and (5) applying paint to the window frame abutting the outer edges of the paint mask.

BRIEF DESCRIPTION OF THE DRAWINGS

The accompanying drawings are included to provide an understanding of the invention and constitute a part of the specification.

DETAILED DESCRIPTION OF THE PREFERRED EMBODIMENTS

Figure 1:
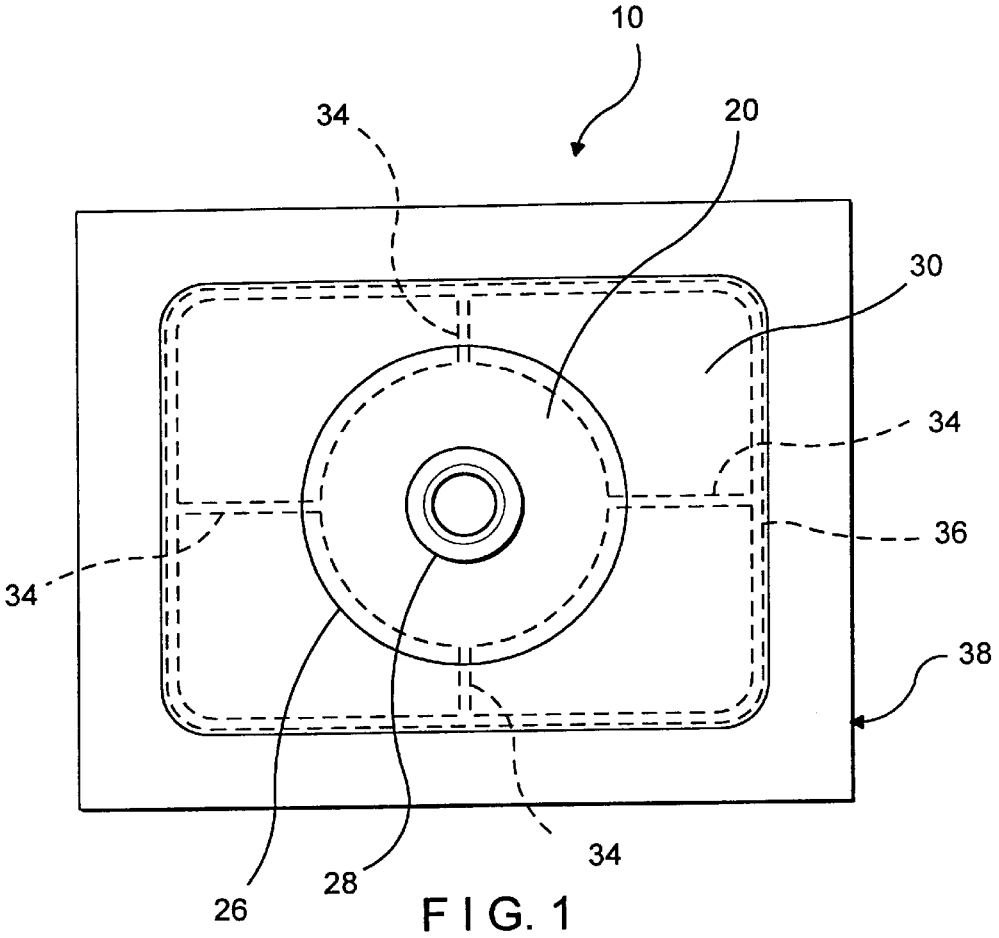
FIG. 1 illustrates a top view of a rectangular paint mask developed in accordance with the present invention and a top view of a handle for use with the invention.
Figure 2:
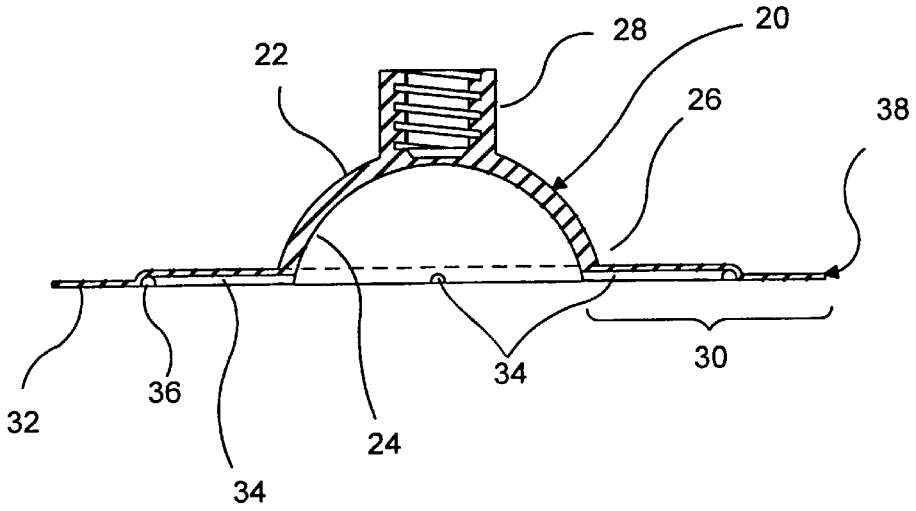
FIG. 2 illustrates a cross sectional view of the paint mask of FIG. 1 and a side view of the handle in FIG. 1.

FIGS. 1 and 2 show a rectangular paint mask 10 which was developed in accordance with the present invention. The paint mask 10 includes a suction cup 20 and a flange 30 molded or fabricated in a single piece from an elastic, substantially gas impermeable material, preferably rubber or polypropylene.

It is important to note that any elastic material can be used so long as the material will return substantially to its original shape after being deformed. It is also important to note that any substantially gas impermeable material can be used so long as the material, when in the form of a sealed container, can preserve an interior partial vacuum against an external atmospheric pressure for a time period sufficient to apply paint to a nearby surface, preferably for at least about one hour. Further examples of suitable materials include, but are not limited to vinyl, propylene, polyethylene, plastics and elastomers.

The suction cup 20 has a outer surface 22, a concave inner surface 24, a circumferential edge 26 and, optionally, a device 28 for engaging or releasing the suction cup 20.

The flange 30 has a lower surface 32 for contacting the area to be masked. The flange 30 also has radial channels 34. The surfaces of the channels 34 are designed such that they are continuous with the inner surface of the suction cup 20. The flange 30 also includes channel 36 which is concentric with the circumferential edge of the suction cup 20 and substantially parallel to the outer edge of the flange 30. The channel 36 is designed such that it intersects the radial channels 34, and has a surface which is continuous with the surfaces of radial channels 34 and an outer edge 38.

In the paint mask of FIGS. 1 and 2, the device 28 for engaging or releasing the suction cup 20 is a threaded socket for receiving optional threaded handle which is not shown. In an alternative embodiment, the device 28 for engaging or releasing the cup may be a grip or knob integral to molded paint mask.

In other alternative embodiments, the channel 36 may be concentric with the circumferential edge of the suction cup 20 but not substantially parallel to the outer edge of the flange 30 or, alternatively, substantially parallel to the outer edge of the flange 30 but not concentric with the circumferential edge of the suction cup 30. In a further alternative embodiment, the channel 36 may be entirely absent or their may be more than one channel 36.

Figure 3:
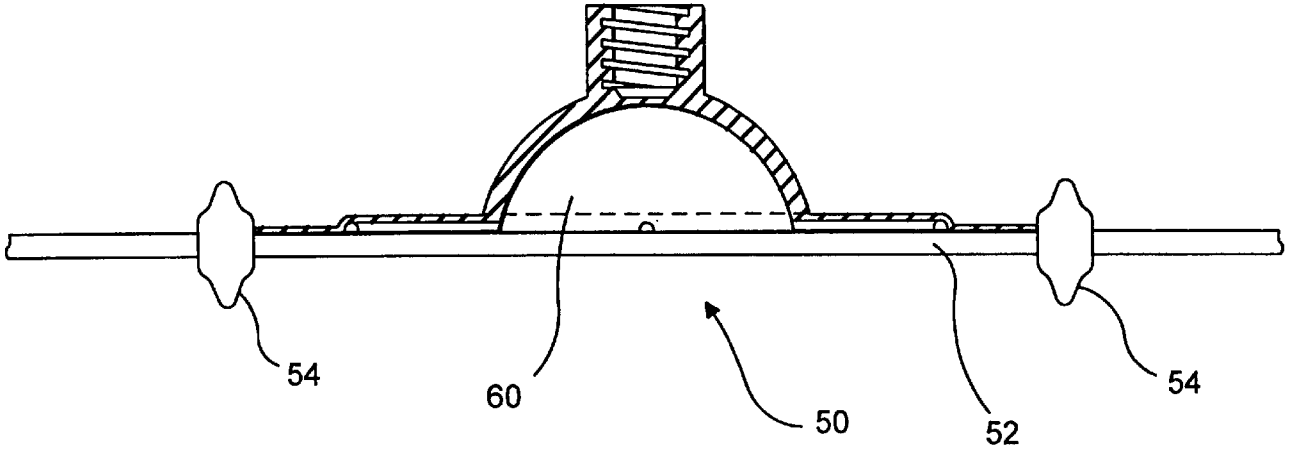
FIG. 3 illustrates a cross sectional view of the paint mask of FIG. 1 applied to a window pane.

FIG. 3 depicts the paint mask of FIGS. 1 and 2 when initially placed on a window 50 having a window pane 52 and a window frame 54. The paint mask exactly covers the entire surface of the window pane 52 so that when the window frame 54 is painted, paint will be prevented from accumulating on the window pane 52. An enclosed space 60 is formed between the suction cup 20, communicating channels 34 and 36, and the window pane 52.

Figure 4:
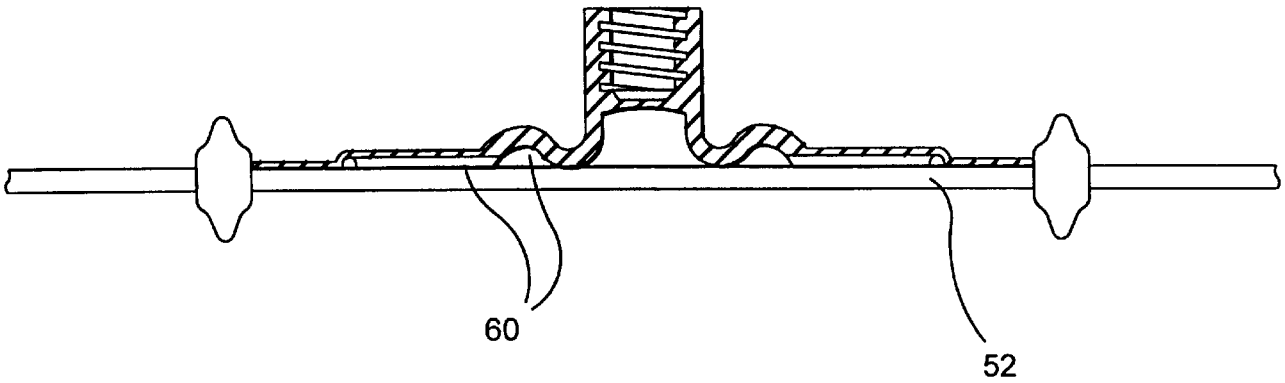
FIG. 4 illustrates a cross sectional view of the paint mask of FIG. 3 after the suction cup has been pressed down and released to adhere the paint mask to the window pane.

FIG. 4 depicts the paint mask and window of FIG. 3 after the device 28 of the suction cup 20 has been pressed toward the window pane 52, forcing a portion of the air inside the enclosed space 60 out from under the flange 30 into the atmosphere, and then released. Once this occurs, the elastic nature of the suction cup 20 attempts to return the suction cup 20 to its normal shape. This results in a partial vacuum being formed in the enclosed space 60. As used herein, the term "partial vacuum" describes a condition when the air pressure inside the space 60 is less than atmospheric air pressure outside the space 60.

As an aid to forming an air-tight seal on this partial vacuum, a pressure sensitive adhesive may be applied to the lower surface of the flange 30 before it is placed on the surface to be masked. Since there now exists a reduced air pressure in the enclosed space 60, the higher atmospheric pressure will press the paint mask 10 against the window pane 52, maintaining its position. Examples of pressure sensitive adhesives for use with the present invention include, but are not limited to neoprene, latex and mucilage.

To remove the mask 10 from the window pane 52 after painting, the seal on the enclosed space 60 is broken by pulling up on the outer edge of the flange 30 or pulling up on the device 28 of the suction cup 20.

Figure 5:
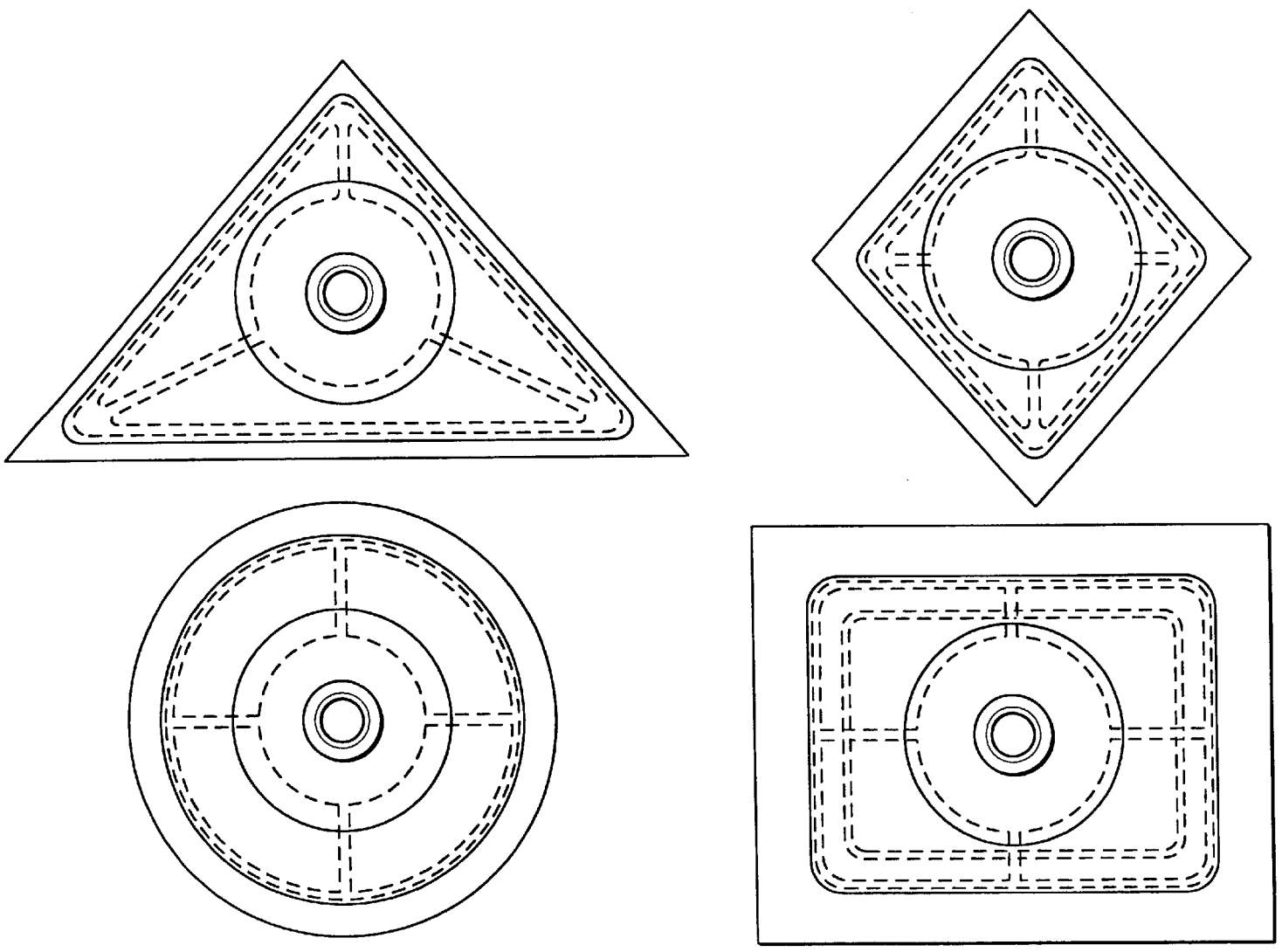
FIG. 5 illustrates top views of addition embodiments of a paint mask developed in accordance the present invention.

FIG. 5 depicts several additional embodiments of paint masks according to the present invention. In particular, FIG. 5 shows a triangular, diamond, and round shaped paint mask, as well as a rectangular paint mask having more than one channel substantially parallel to the edge of the flange.

Figure 6:
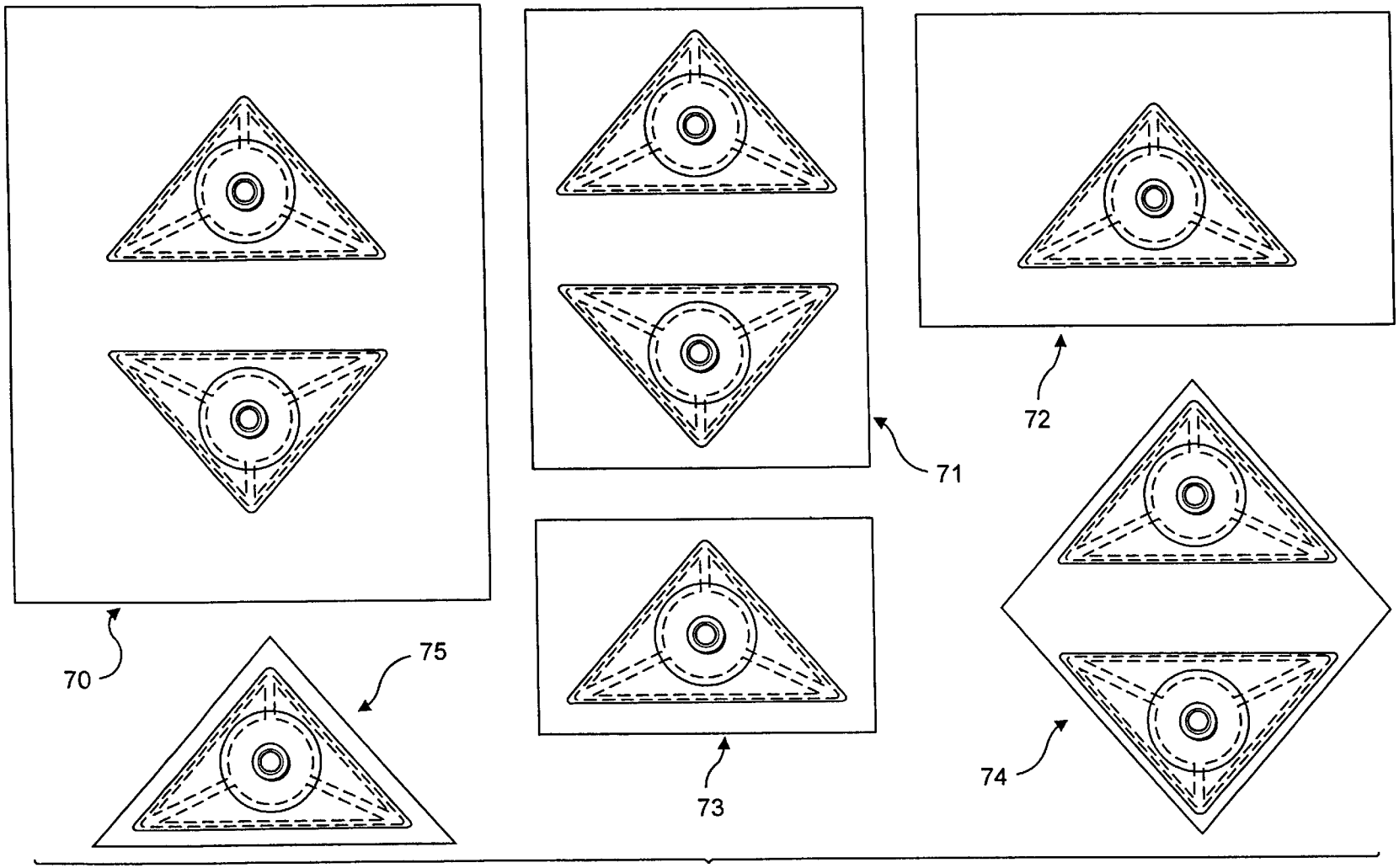
FIG. 6 illustrates top views of an additional embodiment of a plurality of paint masks developed in accordance with the present invention having more than one suction cup and a plurality of sizes and shapes into which it can be trimmed by the user.

In further alternative embodiments, the paint mask may contain more than one suction cup. For example, FIG. 6, depicts a single manufactured paint mask 70 having two suction cups which can be trimmed by the end user into a number of different sizes and shapes shown as reference numerals 71, 72, 73, 74 and 75. It is also important to note that while the suction cup described herein is depicted as hemispherical, the suction cup can also be shaped as an ellipsoid, accordion or bellows.

Whenever more than one suction cup is present in a mask, each channel in the flange communicates with only one suction cup. Preferably, each suction cup and its communicating passages are in a discreet section of the paint mask. The presence of more than one suction cup in a paint mask is particularly useful as the size of the paint mask, and therefore its weight, rises.

Based on the foregoing, it can be seen that a paint mask according to the present invention is formed of an elastic material and has a suction cup and an attached flange surrounding the suction cup. The combination of the suction cup and attached flange is sized and shaped to cover the surface to be masked against paint application. In the lower surface of the flange, which will contact the surface to be masked, there are one or more channels which communicate with the suction cups. These channels do not intersect the outer edge of the flange.

When the paint mask is placed on the surface to be masked, an enclosed space is formed between the surface to be masked, the inner surface of the suction cup and the channels communicating with the suction cup. By pressing on the outer surface of the suction cup, a portion of the air in the enclosed space is forced out. When the outer surface of the suction cup is released, the elastic material will cause the suction cup to partially return to it's original shape, thereby causing a partial vacuum in the enclosed space. As a result of this partial vacuum, the external atmospheric pressure holds the paint mask tightly against the surface to be masked.

This construction is particularly advantageous in that the partial vacuum created in the suction cup is not centralized to that suction cup only, but is formed also in the communicating channels throughout the flange, thereby firmly fixing the suction cup and a majority of the flange to the surface to be masked. Additional advantages of the invention include the low cost of molding the invention as a single unit, and the ability to trim the flange of the inexpensive unit to fit a severalty of sizes and shapes.

It is, of course, to be understood that various changes may be made to embodiments of the paint mask described above without departing from the scope of the invention. For example, paint masks can be made according to the present invention in any desired shape or size. Additionally, the channels formed in the lower surface of the flange do not have to be radial, concentric to the suction cup or substantially parallel to the outer edge of the flange. The channels may have any configuration, as long as they do not intersect the outer edge of the flange, which would communicate the interior of the suction cup to the atmosphere and prevent an enclosed space from being formed. In another example, the flange may be contoured to fit a surface to be masked which is not flat.

I claim:

1. A paint mask for protecting an area from paint which is being applied to an adjacent or nearby area, the paint mask comprising:

a suction cup formed of an elastic, substantially gas-impermeable material, the suction cup having a concave inner surface and an outer surface;

a flange formed of an elastic, substantially gas-impermeable material, the flange being attached to the suction cup and having a lower surface sized and shaped, in combination with the inner surface of the suction cup, to cover the area to be protected; and at least one channel in the lower surface of the flange, the surface of the channel being continuous with the concave inner surface of the suction cup;

wherein, upon placing the paint mask on the surface to be protected an enclosed space is defined by the concave inner surface of the suction cup, the surface of the channel, and the surface to be protected; and a partial vacuum can be created in the enclosed space by pressing on the outer surface of the suction cup to force a portion of the air contained in the enclosed space out of the enclosed space, followed by releasing the outer surface of the suction cup.

2. The paint mask of claim 1, wherein:

the suction cup has a circumferential edge;

the flange has an outer edge; and at least one channel is a radial channel which extends radially a part of the distance from the circumferential edge of the suction cup to the outer edge of the flange.

3. The paint mask of claim 2, further comprising:

at least one circumferential channel in the lower surface of the flange running substantially parallel to the outer edge of the flange and intersecting the radial channel, the surface of the circumferential channel being continuous with the surface of the intersecting radial channel, wherein, the enclosed space is defined by the concave inner surface of the suction cup, the surface of each of the channels and the surface to be protected.

4. The paint mask of claim 2, further comprising:

at least one concentric channel in the lower surface of the flange concentric to the circumferential edge of the suction cup and intersecting the radial channel, the surface of the concentric channel being continuous with the surface of the intersecting radial channel, wherein, the enclosed space is defined by the concave inner surface of the suction cup, the surface of each of the channels and the surface to be protected.

5. The paint mask of claim 1, further comprising a pressure sensitive adhesive applied to the lower surface of the flange.

6. The paint mask of claim 5, wherein the pressure sensitive adhesive is selected from the group consisting of neoprene, latex and mucilage.

7. The paint mask of claim 1, wherein the suction cup and the flange are a single molded unit of the elastic, substantially gas-impermeable material.

8. The paint mask of claim 7, wherein the substantially gas-impermeable material is at least one of rubber and polypropylene.

9. A paint mask for protecting an area from paint which is being applied to an adjacent or nearby area, the paint mask comprising:

a plurality of suction cups formed of an elastic, substantially gas-impermeable material, each suction cup having a concave inner surface and an outer surface;

a flange formed of an elastic, substantially gas-impermeable material, the flange being attached to each suction cup and having a lower surface sized and shaped, in combination with the inner surfaces of the suction cups, to cover the area to be protected; and a plurality of channels in the lower surface of the flange, the surface of each channel being continuous with the concave inner surface of one of the suction cups;

wherein, upon placing the paint mask on the surface to be protected an enclosed space is defined for each suction cup, that space being defined by the concave inner surface of that suction cup, the surfaces of the channels having surfaces continuous with the concave inner surface of that suction cup, and the surface to be protected; and a partial vacuum can be created in each enclosed space by pressing on the outer surface of each suction cup to force a portion of the air contained in the enclosed space out of the enclosed space, followed by releasing the outer surface of each suction cup.

10. The paint mask of claim 9, wherein:

each suction cup has a circumferential edge;

the flange has an outer edge; and at least one of the channels extends radially a part of the distance from the circumferential edge of one of the suction cups to the outer edge of the flange.

11. The paint mask of claim 10, further comprising:

at least one channel in the lower surface of the flange running substantially parallel to the outer edge of the flange and intersecting at least one of the radial channels, the surface of the channel substantially parallel to the outer edge being continuous with the surface of the intersecting radial channel, wherein, each enclosed space is defined by the concave inner surface of each suction cup, the surface of each of the channels having surfaces continuous with the inner surface of that suction cup, the surface of each of the channels intersecting each of the channels having surfaces continuous with the inner surface of that suction cup and the surface to be protected.

12. The paint mask of claim 10, further comprising:

at least one channel in the lower surface of the flange concentric to the circumferential edge of one of the suction cups and intersecting at least one of the radial channels, the surface of the concentric channel being continuous with the surface of the intersecting radial channel, wherein, each enclosed space is defined by the concave inner surface of each suction cup, the surface of each of the channels having surfaces continuous with the inner surface of that suction cup, the surface of each of the channels intersecting each of the channels having surfaces continuous with the inner surface of that suction cup and the surface to be protected.

13. The paint mask of claim 9, further comprising a pressure sensitive adhesive applied to the lower surface of the flange.

14. The paint mask of claim 13, wherein the pressure sensitive adhesive is selected from the group consisting of neoprene, latex and mucilage.

15. The paint mask of claim 9, wherein the suction cup and the flange are a single molded unit of the elastic, substantially gas -impermeable material.

16. The paint mask of claim 9, wherein the substantially gas-impermeable material is at least one of rubber and polypropylene.

17. The paint mask of claim 9 wherein each enclosed space is located under a discreet section of the paint mask.

18. A method of painting a window frame containing a window pane, the method comprising the steps of:

(1) providing a paint mask for protecting the window pane from paint, the paint mask comprising: a plurality of suction cups formed of an elastic, substantially gas-impermeable material, each suction cup having a concave inner surface and an outer surface; a flange formed of an elastic, substantially gas-impermeable material, the flange being attached to each suction cup and having a lower surface sized and shaped, in combination with the inner surfaces of the suction cups, to cover the window pane; and plurality of channels in the lower surface of the flange, the surface of each channel being continuous with the concave inner surface of one of the suction cups; wherein, upon placing the paint mask on the window pane, an enclosed space is defined for each suction cup, that space being defined by the concave inner surface of that suction cup, the surfaces of the channels having surfaces continuous with the concave inner surface of that suction cup and the surface of the window pane;

(2) trimming the flange of the paint mask on one or more sides to form an outer edge;

(3) placing the trimmed paint mask over the window pane with the outer edge abutting the window frame, such that the entire surface of one side of the window pane is shielded from paint application;

(4) creating a partial vacuum in the enclosed space by pressing on the outer surface of each suction cup to force a portion of the air contained in the enclosed space out of the enclosed space, followed by releasing the outer surface of each suction cup; and (5) applying paint to the window frame abutting the outer edges of the paint mask.

* * * * *